US010751858B1

(12) United States Patent
Gershkovich et al.

(10) Patent No.: US 10,751,858 B1
(45) Date of Patent: Aug. 25, 2020

(54) HARDWARE INSTALLATION AID

(71) Applicant: Lockheed Martin Corporation, Bethesda, MD (US)

(72) Inventors: Ilya Gershkovich, Philadelphia, PA (US); Kirk J. Witherow, Perkasie, PA (US)

(73) Assignee: Lockhead Martin Corporation, Bethesda, MD (US)

( * ) Notice: Subject to any disclaimer, the term of this patent is extended or adjusted under 35 U.S.C. 154(b) by 49 days.

(21) Appl. No.: 15/380,019

(22) Filed: Dec. 15, 2016

(51) Int. Cl.

| | |
|---|---|
| ***B25B 13/06*** | (2006.01) |
| ***B25B 23/00*** | (2006.01) |
| ***B25B 21/00*** | (2006.01) |
| ***B25B 13/46*** | (2006.01) |

(52) U.S. Cl.
CPC ..... *B25B 13/065* (2013.01); *B25B 13/46* (2013.01); *B25B 21/007* (2013.01); *B25B 23/0057* (2013.01)

(58) Field of Classification Search
CPC ..... B25B 21/007; B25B 23/0057
USPC ..... 81/124.4
See application file for complete search history.

(56) References Cited

U.S. PATENT DOCUMENTS 1,590,200 A * 6/1926 McGuckin ..... B25B 13/065 279/99
3,707,894 A * 1/1973 Stillwagon, Jr. ..... B25B 23/12 81/125
3,869,942 A 3/1975 DeCaro
4,738,168 A 4/1988 Carminati
D359,669 S * 6/1995 Splingaire ..... D8/29
5,896,792 A 4/1999 Hurt
5,974,916 A * 11/1999 Lassiter ..... B25B 27/0057 81/121.1
6,003,411 A * 12/1999 Knox ..... B25B 27/18 81/124.3
6,672,547 B1 1/2004 Westerberg et al.
6,922,887 B1 * 8/2005 Keswani ..... B25B 13/06 29/729
7,093,338 B2 8/2006 Powers et al.
9,416,810 B2 * 8/2016 Swinderman ..... F16B 41/002
2005/0109167 A1 * 5/2005 Ainsworth ..... B25B 13/06 81/121.1

* cited by examiner

*Primary Examiner* — Hadi Shakeri
(74) *Attorney, Agent, or Firm* — Howard IP Law Group, PC

(57) ABSTRACT

An adapter for aiding in the installation of a fastener assembly includes a body defining a first aperture formed in a first end thereof and configured to receive at least a portion of the fastener assembly. The first aperture is defined by at least one tapered sidewall of the body, wherein the first aperture is sized in a region or area of the at least one tapered sidewall to engage with a component of the fastener assembly when the fastener assembly is received therein. The body further defines a drive surface within the first aperture for engaging with a corresponding drive surface of a component of the fastener assembly when the fastener assembly is received within the first aperture. A second aperture is defined in a second end of the body, opposite the first end, and is configured to engage with a tool for installing the fastener assembly.

18 Claims, 8 Drawing Sheets

| SIZE | INSIDE DIAMETER | OUTSIDE DIAMETER | THICKNESS |
|---|---|---|---|
| | | | |
| SAE FLAT WASHERS | | | |
| #6 | 5/32" | 3/8" | 3/64" |
| #8 | 3/16" | 7/16" | 3/64" |
| #10 | 7/32" | 1/2" | 3/64" |
| 1/4 | 9/32" | 5/8" | 1/16" |
| 5/16 | 11/32" | 11/16" | 1/16" |
| 3/8 | 13/32" | 13/16" | 1/16" |
| 7/16 | 15/32" | 59/64" | 1/16" |
| 1/2 | 17/32" | 1-1/16" | 3/32" |
| 9/16 | 19/32" | 1-3/16" | 3/32" |
| 5/8 | 21/32" | 1-5/16" | 3/32" |
| 3/4 | 13/16" | 1-1/2" | 9/64" |
| 7/8 | 15/16" | 1-3/4" | 9/64" |
| 1" | 1-1/16" | 2" | 9/64" |
| 1-1/8" | 1-3/16" | 2-1/4" | 9/64" |
| 1-1/4" | 1-5/16" | 2-1/2" | 5/32" |
| 1-1/2" | 1-7/16" | 3" | 3/16" |

*FIG. 7*

HARDWARE INSTALLATION AID

STATEMENT OF GOVERNMENT INTEREST

This invention was made with Government support under Contract No. FA8709-14-C-0001 awarded by the Department of the Air Force. The Government has certain rights in this invention.

FIELD OF THE INVENTION

The present invention relates generally to systems for aiding in the installation of fasteners and other hardware.

BACKGROUND

Hardware or fastener (e.g. nuts, bolts, screws, washers) installation operations often involve difficult to reach placement locations and particular hardware orientations that increase risk of mishandling (e.g. dropping) the hardware before it can be installed or otherwise engaged with an appropriate receiving member. In the case of a rotatably engaging hardware element, such as a nut or a bolt driven by a tool such as a socket and ratchet combination, the risk includes hardware becoming dislodged from the socket prior to achieving threaded engagement. This can be particularly problematic in applications involving sensitive equipment and/or confined spaces, wherein dropping a fastener not only increases the time and expense involved completing the task, but also risks causing it to be lost, or poses a risk of damage to, or improper operation of, the equipment.

Existing solutions to this problem include magnetic tools, which cannot be used with stainless steel hardware. Other methods utilize rubberized elements, such as sleeves configured to be fitted over the hardware to be installed. These solutions, however, prove difficult to use with nuts and other smaller fasteners, and are subject to performance degradation over time. Specialty captive hardware also exists, however, these components are significantly more expensive than standard fasteners, and are often weaker due to the presence of undercuts, for example.

Alternative solutions to selectively and temporarily secure or captivate a fastener to a tool are desired.

SUMMARY

According to one embodiment of the present disclosure, an adapter for aiding the installation of a fastener assembly is provided. The adapter includes a body defining a first aperture formed in a first end thereof and configured to receive at least a portion of the fastener assembly. The aperture is defined by at least one tapered sidewall of the body, wherein the aperture is sized in a region of the at least one tapered sidewall to engage with a component of the fastener assembly when the fastener assembly is received therein. The body further defines a drive surface within the first aperture for engaging with a corresponding drive surface of a component of the fastener assembly when the fastener assembly is received within the aperture. A second aperture is defined in a second end of the body, opposite the first end, and is configured to engage with a tool for installing the fastener assembly. A fastener assembly installation tool may also be provided and includes a first end for facilitating the application of a pressing force thereon, as well as a second end configured to receive a component of the fastener assembly therein, and to engage with another component of the fastener assembly for generating a press or friction fit between a component of the fastener assembly and the at least one tapered sidewall of the adapter.

BRIEF DESCRIPTION OF THE DRAWINGS

FIG. 7 is a table showing standard sizes of SAE washers useful for designing adapters according to embodiments of the present disclosure.

DETAILED DESCRIPTION

Figure 1A:
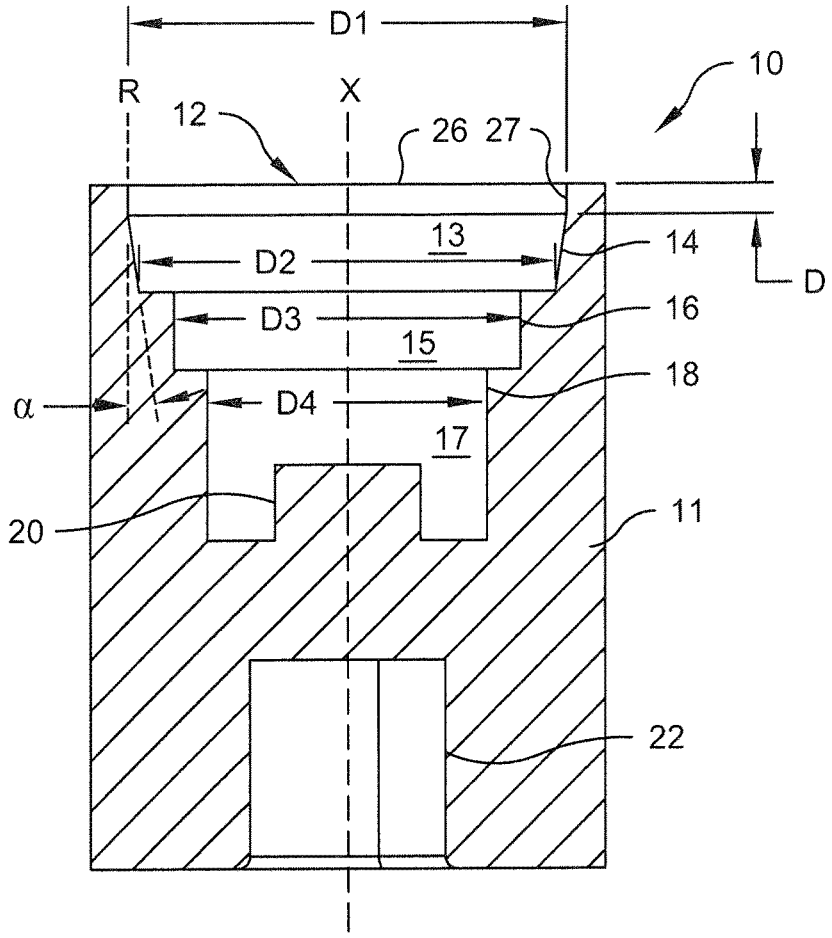
FIG. 1A is a cross-sectional view of a fastener or hardware installation aid or adapter according to an embodiment of the present disclosure.

It is to be understood that the figures and descriptions of the present invention have been simplified to illustrate elements that are relevant for a clear understanding of the present invention, while eliminating, for purposes of clarity, many other features found in fastening systems, including threaded fasteners and their features, as well as tools commonly used to aid in their installation. However, because such elements are well known in the art, and because they do not facilitate a better understanding of the present invention, a discussion of such elements is not provided herein. The disclosure herein is directed to all such variations and modifications known to those skilled in the art.

In the following detailed description, reference is made to the accompanying drawings that show, by way of illustration, specific embodiments in which the invention may be practiced. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout several views.

Embodiments of the present disclosure include adapters for aiding in the installation of fastener assemblies or fastener stacks, such as those including a nut or a bolt, and at least one washer. Adapters set forth herein are configured to securely hold a fastener assembly in a first end thereof and attach to a hardware insertion tool on a second end thereof. Rotational torque generated by the tool is transmitted through the adapter and to the fastener assembly, enabling installation thereof without a risk of the fastener become dislodged from the tool. More specifically, adapters according to embodiments of the present disclosure include a body defining a first aperture formed in a first end thereof and configured to receive at least a portion of a fastener assembly. The first aperture is defined by at least one tapered sidewall of the body and sized in a region of the at least one tapered sidewall to engage with a component of the fastener assembly when the fastener assembly is received therein. The body further defines a drive surface within the first aperture for engaging with a corresponding drive surface of a component of the fastener assembly when the fastener assembly is received within the first aperture. A second aperture is defined in a second end of the body, opposite the first end, and is configured to engage with a tool for enabling the application of rotational torque on the fastener assembly.

Figure 1B:
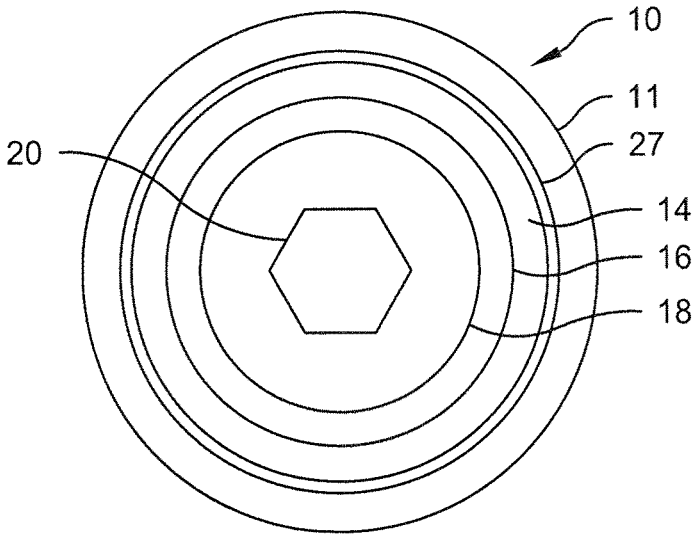
FIG. 1B is a top view of the adapter of FIG. 1A.

Referring generally to FIGS. 1A and 1B, an adapter 10 according to an embodiment of the present disclosure includes a body 11 defining an aperture 12 configured to receive a fastener combination or fastener stack, such as a nut or a bolt and at least one washer. In the exemplary embodiment, aperture 12 defines a first space 13, a second space 15, and a third space 17. In one embodiment, an open end 26 of first space 13 comprises a cylindrical profile defined by a generally vertical sidewall 27 of body 11 extending therein to at least a depth D thereof (i.e. a counterbore). First space 13 may be further defined by an annular sidewall 14 formed in body 11. In one embodiment, sidewall 14 comprises a linearly tapered sidewall defining a first diameter D1 proximate open end 26 of aperture 12 or first space 13, and a second diameter D2 oriented generally at a second end of first space 13, such that sidewall 14 comprises a taper angle of a with respect to a reference line R oriented generally parallel to a central axis X of adapter 10. As set forth in greater detail herein, tapered sidewall 14 of aperture of first space 13 is configured to provide an interference fit with at least one washer of a fastener stack or assembly of a predetermined size.

Second space 15 may comprise a generally cylindrical space defined by a vertical, annular sidewall 16 of a diameter D3, with diameter D3 being smaller than at least diameter D1, and in one embodiment, also smaller than diameter D2. Second space 15 may be configured (sized and oriented) to accept a hardware component, such as lock washer of a hardware stack. Third space 17 may also comprise a generally cylindrical space of a diameter D4, with diameter D4 being smaller than at least diameter D1, and in one embodiment, smaller than diameter D2 and diameter D3. Third space 17 is defined by a vertical, annular sidewall 18 of body 11. Third space 17 may be configured (i.e. sized and oriented) to accept another hardware component, such as a head of a threaded fastener of a hardware stack.

In the exemplary embodiment, body 11 further defines a torque-transferring internal drive feature or drive protrusion 20 extending from an end of third space 17 in an axial direction of adapter 10 and generally toward open end 26 of aperture 12. Drive protrusion 20 is configured (i.e. sized and positioned) to engage with a corresponding recess of a threaded fastener of a hardware stack. In one embodiment, drive protrusion 20 comprises a hexagonal cross-section (i.e. a hex or socket drive as shown in FIG. 1B) sized to engage with, for example, a correspondingly-sized recess of a socket head cap screw of a hardware stack. In other embodiments, by way of example only, drive protrusion 20 may comprise a square, torx, Phillips or other flat/slotted head-style protrusion. Body 11 of adapter 10 further comprises a drive recess or aperture 22 configured to receive a drive end of a tool. For example, recess 22 may be comprise a generally square cross-section for accepting a corresponding square drive end of a tool (e.g., a ¼", ⅜" or ½" drive end of a torque or ratcheting wrench).

Figure 2A:
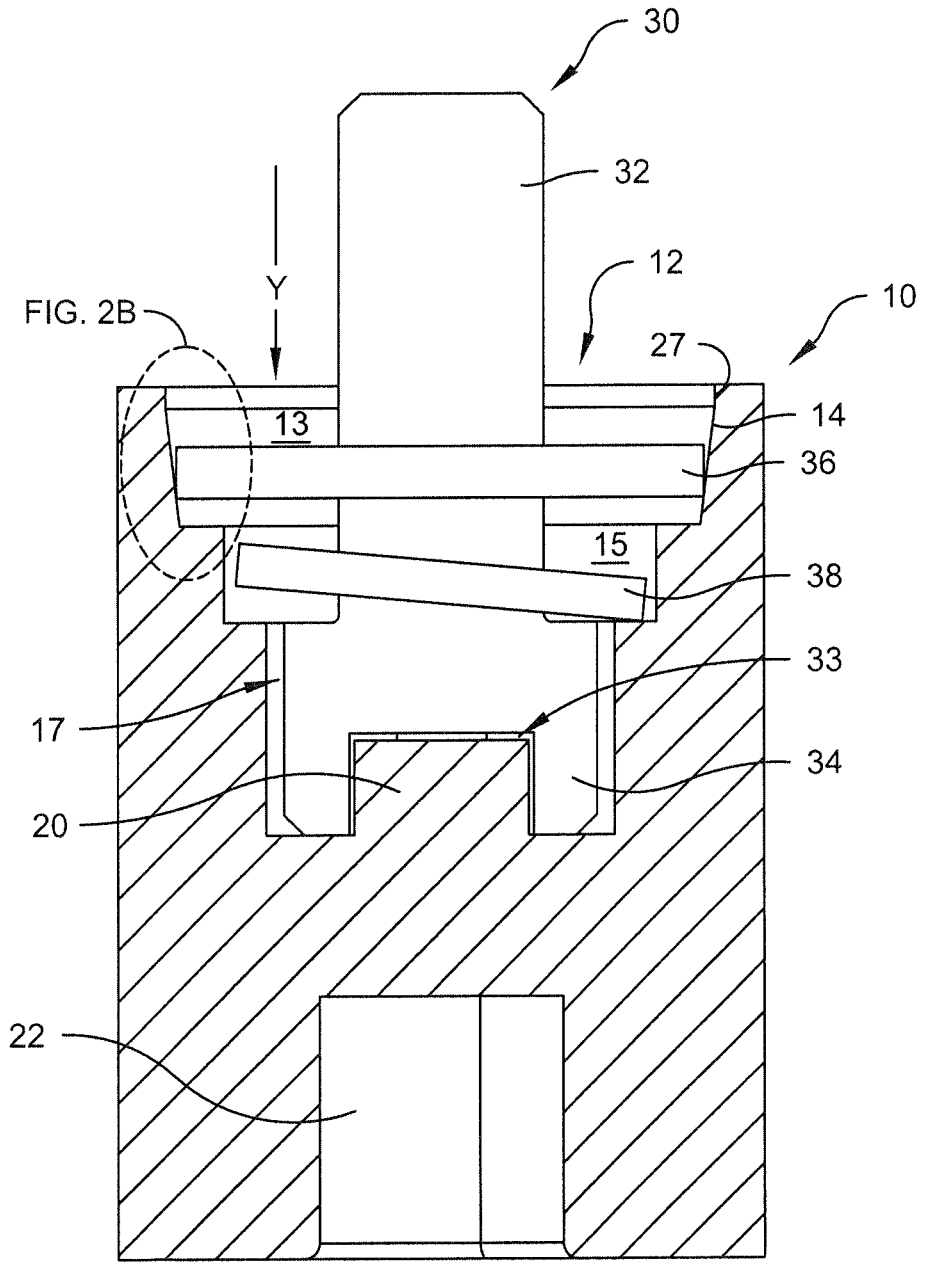
FIG. 2A is a cross-sectional view of the hardware installation adapter of FIGS. 1A and 1B, with a hardware assembly held securely therein.

FIG. 2A illustrates adapter 10 of FIGS. 1A and 1B, with a fastener combination or stack 30 held captive therein. In the exemplary illustrated embodiment, fastener stack 30 comprises a threaded cap screw 32, a first washer 36 (e.g. a standard-sized flat washer or a standard-sized lock washer) and a second washer 38 (e.g. a standard-sized flat washer or a standard-sized lock washer). Drive protrusion 20 is engaged with a correspondingly-sized recess 33 formed in a head 34 of cap screw 32 and is configured to transmit rotational torque from a tool engaged in drive recess 22 to cap screw 32. As shown, third space 17 is sized to freely accept (e.g. in a clearance fit manner) head 34 of cap screw 32. Likewise, second space 15 is sized to freely accept second washer 38.

First washer 36 is friction or interference fit within adapter 10 via annular tapered sidewall 14 defining first space 13. This friction fit is generated in response to the application of force on first washer 36 in the indicated axial direction Y. More specifically, referring generally to FIG. 2B, adapter 10 is configured such that diameter D1 is larger than a diameter of first washer 36 (i.e., a washer of a known size), while diameter D2 is selected so as to be smaller than the diameter of first washer 36. In this way, in response to adequate force on washer 36 in direction Y, first washer 36 will be urged into a friction fit with tapered sidewall 14 in a region or area of first space 13 generally between diameter D1 and diameter D2 thereof.

In order to ensure a suitable friction fit in a desired region of first space 13, adapters according to embodiments of the present disclosure may be preconfigured to achieve a friction fit with a desired standard-sized washer or other fastening component. For example, FIG. 7 provides an exemplary table illustrating standard SAE washer sizing which may be used to select suitable dimensions for adapter 10. Specifically, diameters D1 and D2 may be chosen to be larger and smaller, respectively, than an outside diameter of a predetermined washer to be held by the adapter. By way of example only, if an adapter is configured to install a fastener assembly including a #10 washer having a nominal outer diameter of ½ inch, an adapter may be formed with a diameter D1 of 9/16ths of an inch and a diameter D2 of 7/16ths of an inch, or with diameters D1 and D2 approximately equal to respective upper and lower tolerance limits of a given washer, with a sidewall linearly tapering therebetween, by way of example only. Similar standard sizing tables may be referenced for sizing second space 15 and third space 17, well as the dimension of drive protrusion 20 for the fastener type being used.

Figure 2B:
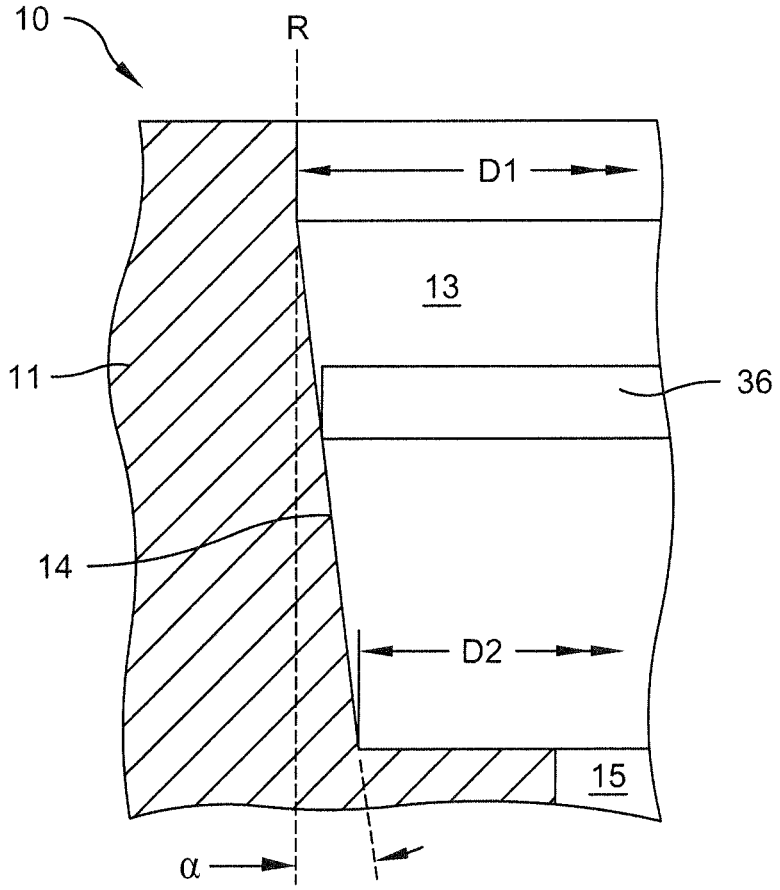
FIG. 2B is a detailed cross-sectional view of a portion of FIG. 2A.
Figure 3A:
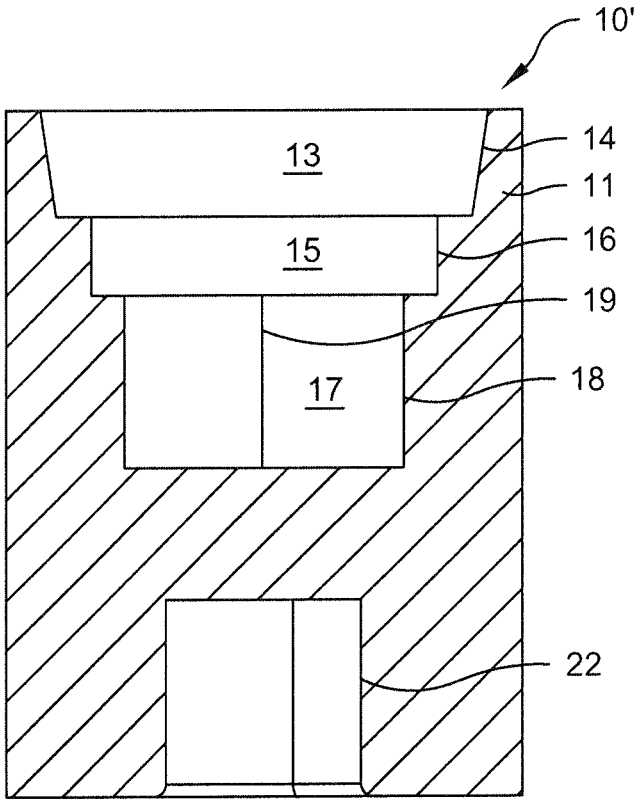
FIG. 3A is a cross-sectional view of a hardware installation adapter according to another embodiment of the present disclosure.
Figure 3B:
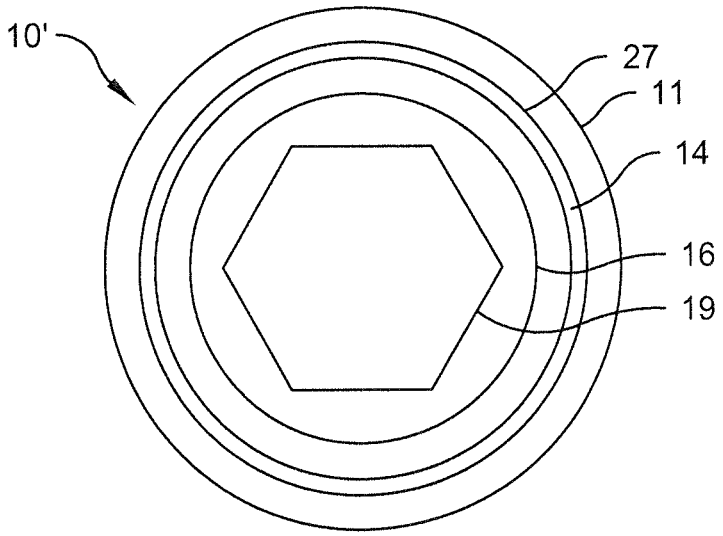
FIG. 3B is a top view of the adapter of FIG. 3A.

Referring generally to FIGS. 3A and 3B, a second embodiment of an adapter 10' according to the present disclosure comprises features similar to those set forth above with respect to FIGS. 1A, 1B, 2A and 2B, which are represented by like-numerals. In the embodiment of FIGS. 3A and 3B, however, adapter 10' is configured to engage with a fastener (e.g. a bolt or a nut) having a male drive profile, such as a hexagonal profile, by way of example only. In this way, drive protrusion 20 of the embodiment of FIGS. 1A-2B is not present, and third space 17 has been sized so as to define a drive surface, in this instance, an internal socket. Specifically, an internal sidewall 19 of body 11 in third space 17 defines a female hexagonal cross-section for engaging with a corresponding male hexagonal exterior surface of a head of a fastener or of a nut. In other embodiments, internal sidewall 19 may define a square profile, or a female or external torx profile, by way of further non-limiting example. The capacitive function of adapter 10' is unchanged from the previously-described embodiment, wherein a fastener component, such as a washer, is configured to be friction fit with tapered internal sidewall 14 of adapter 10', as shown in FIGS. 2A and 2B.

Figure 4:
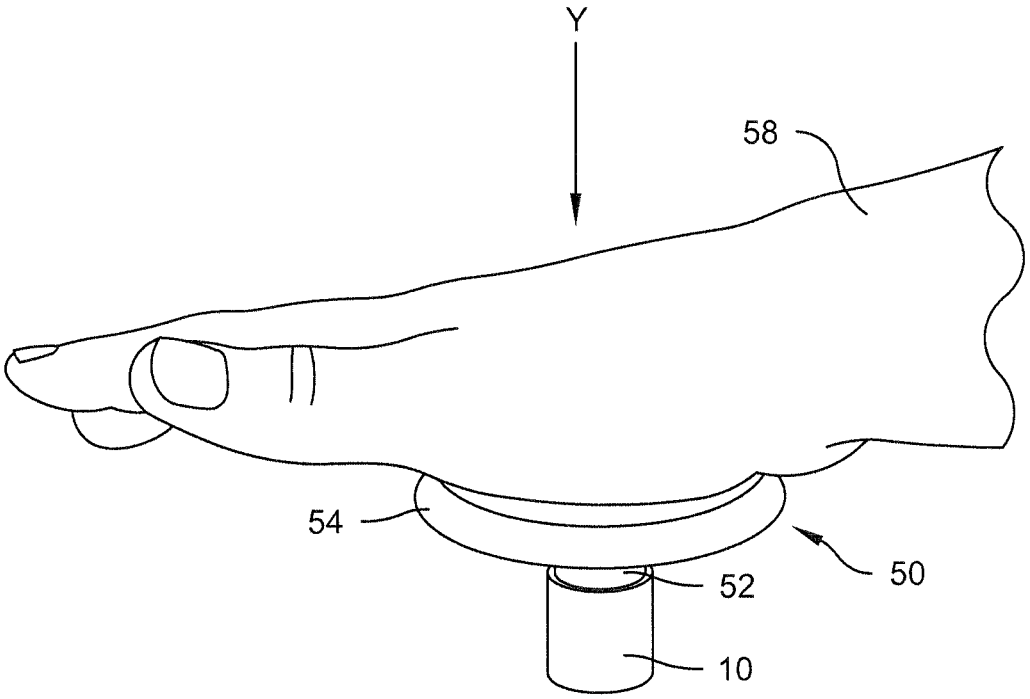
FIG. 4 is a perspective view of a hardware insertion tool according to an embodiment of the present disclosure.
Figure 5:
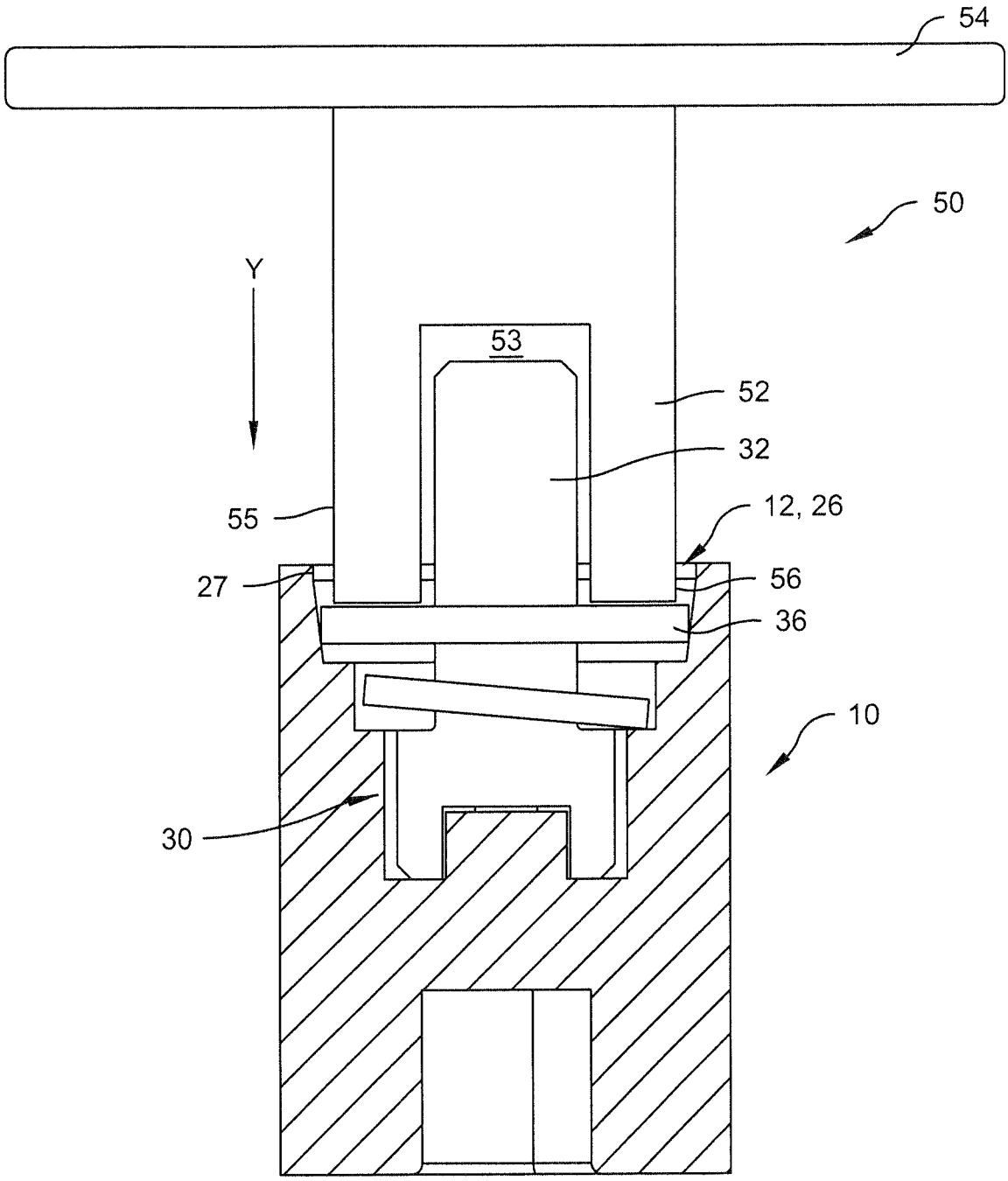
FIG. 5 is a cross-sectional view of the hardware installation adapter and hardware assembly of FIG. 2A with the hardware insertion tool of FIG. 4 engaged therewith.

As set forth above, the captive function of an adapter according to embodiments of the present disclosure is achieved by press-fitting a component (e.g. a washer) of a fastener combination or stack into an adapter. As illustrated in FIGS. 4 and 5, this force may be applied on one or more components of a fastener combination via a hardware insertion tool embodied as a pressing tool 50. Referring generally to FIG. 4, an exemplary pressing tool 50 includes a first end 52 configured to engage with one or more components of a fastener combination installed within adapter 10, such as with the free end of a threaded fastener and a washer. Pressing tool 50 further includes a second end 54 defining a generally planar surface for facilitating the application of force in direction Y thereon by, for example, a hand of a user 58.

FIG. 5 illustrates the operation of pressing tool 50 in greater detail. As shown, once aligned, an internal recess or bore 53 formed in first free end 52 of pressing tool 50 is configured to accept an end of cap screw 32. Recess 53 accepting the end of cap screw 32 allows for a free end 56 of first end 52 of pressing tool 50 to engage with or abut first washer 36 of fastener stack 30, as described with respect to FIGS. 2A and 2B. An outer annular surface 55 of first free end 52 defining recess 53 comprises a diameter sized to freely pass through open end 26 of recess 12 of adapter 10. In this way, free end 56 of pressing tool 50 is sized to engage with first washer 36, urging first washer 36 into a friction or press-fit with tapered sidewall 14 of adapter 10 in response to force in direction Y. This friction fit provides the capacitive feature which prevents fastener stack 30 from becoming disengaged or dislodged from adapter 10 during an installation operation.

Figure 6:
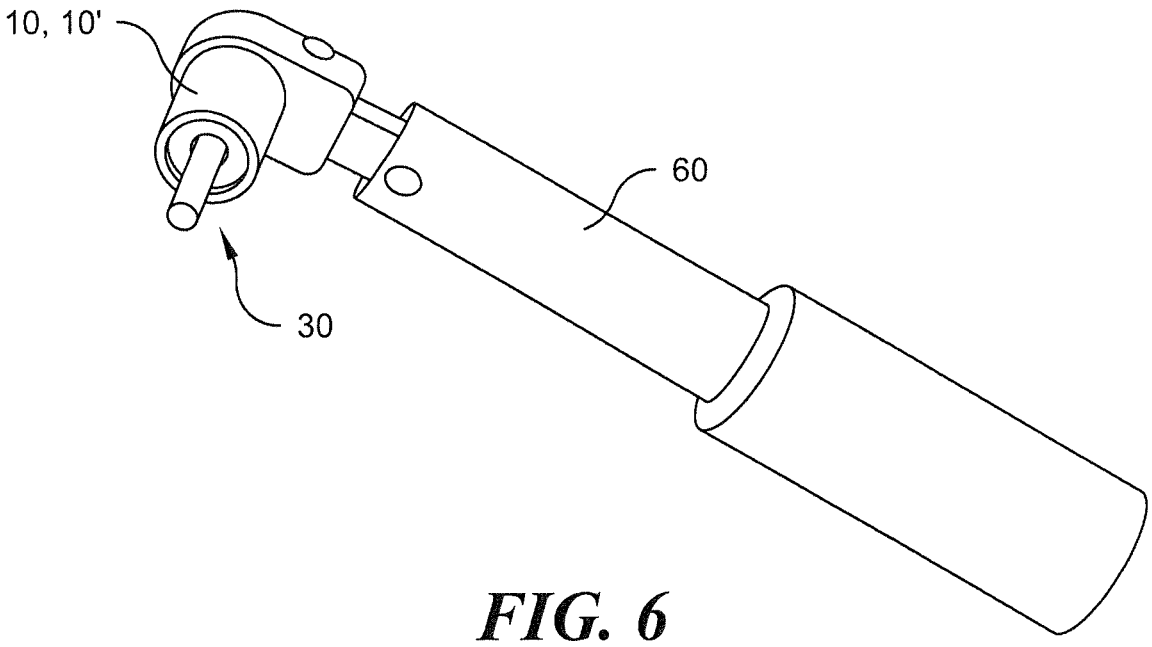
FIG. 6 is a perspective view illustrating a hardware installation adapter according to an embodiment of the present disclosure fitted to a tool and holding a hardware assembly.

As illustrated below in FIG. 6, adapter 10 is shown fitted to a tool 60, in this instance, a torque wrench. Adapter 10 secures fastener combination 30 therein prior to its installation. As will be understood from the figures, and specifically FIG. 2A, in operation, as fastener stack 30 is installed into an object (e.g. threaded into an opening of the object), an end of body 11 of adapter 10 will be drawn toward and into abutment with the object. Once abutted, further threading of cap screw 32 of fastener stack 30 will draw fastener stack 30 out of engagement with adapter 10. More specifically, head 34 of cap screw 32 will begin to abut and bias second washer 38 in a direction opposite that of direction Y, which in turn will abut and bias first washer 36 out of its press-fit engagement with tapered sidewall 14 (e.g. when first washer 36 enters the bore-shaped space defined by vertical wall 27), releasing the capacitive connection therewith and ultimately facilitating removal of the adapter and tool from the fastener after installation is complete.

Adapters and installation or pressing tools according to embodiments of the present disclosure may be manufactured from polymer materials, such as plastic, and formed from suitable manufacturing processes, such as injection molding and/or machining. In one particularly advantageous embodiment, the adapter and/or pressing tool comprises a monolithic body (i.e. one continuous body) and may be manufactured via three-dimensional (3D) printing techniques. The use of polymer materials may be particularly advantageous, as such materials allow for elastic deformation of the adapter for establishing the above-described press or friction fits, while maintaining adapter shape for long service life (i.e. repeated use duty).

While the foregoing invention has been described with reference to the above-described embodiment, various modifications and changes can be made without departing from the spirit of the invention. Accordingly, all such modifications and changes are considered to be within the scope of the appended claims. Accordingly, the specification and the drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations of variations of various embodiments. Combinations of the above embodiments, and other embodiments not specifically described herein, will be apparent to those of skill in the art upon reviewing the above description.

What is claimed is:

1. In combination, an adapter with a fastener assembly comprising:

a fastener assembly including at least one washer and one of a nut or a bolt; and an adapter for securing the fastener assembly to a tool, the adapter comprising:

a body defining:

a first open aperture formed in a first end thereof and defined partially by at least one linearly tapered interior sidewall of the body, the linearly tapered interior sidewall defining a first diameter D1 proximate the first end, and terminating at a second end having a second diameter D2 smaller than the first diameter, the first open aperture configured to receive at least a portion of the fastener assembly and sized in a region of the at least one linearly tapered interior sidewall to allow passage therethrough of the one of the nut or bolt, and engage with one of the at least one washer of the fastener assembly when the fastener assembly is received therein, wherein the tapered interior sidewall defines a first space within the first open aperture, and wherein the first open aperture is further defined by a uniform interior sidewall that defines a second space of uniform diameter less than a smallest diameter of the first space of the tapered sidewall;

a drive surface formed in the body within the first open aperture and configured to engage a corresponding drive surface of the one of the nut or bolt of the fastener assembly when the fastener assembly is received within the first open aperture; and a second aperture defined in a second end of the body, opposite the first end, and configured to engage with a tool for installing the fastener assembly, wherein the apertures are separated by a portion of the body so as not to be in communication with one another, wherein the one of the at least one washer having a diameter between D1 and D2 is inserted into the first open aperture and is engaged in an interference fit with a portion of the linearly tapered interior sidewall, to thereby captivate the fastener assembly within the adapter, and wherein the region of the at least one tapered sidewall that engages with the one of the at least one washer is intermediate the second space of uniform diameter formed in the body and the first end.

2. The adapter of claim 1, wherein the one of the nut or the bolt of the fastener assembly is a bolt, and wherein the drive surface comprises a surface of a protrusion formed on an end of the first open aperture opposite the open end thereof, the protrusion configured to engage a head of the bolt of the fastener assembly.

3. The adapter of claim 2, wherein the drive surface comprises a drive protrusion having drive surfaces facing an interior sidewall of the first open aperture.

4. The adapter according to claim 3, wherein the drive surface comprises a hexagonal cross-section.

5. The adapter of claim 1, wherein the drive surface comprises an interior sidewall of the first aperture.

6. The adapter of claim 5, wherein the drive surface comprises a hexagonal cross-section.

7. The adapter of claim 1, wherein the first open aperture comprises a uniform cylindrical interior sidewall extending from the open end of the aperture and terminating at the linearly tapered interior sidewall.

8. The adapter of claim 1, wherein the second space is configured to receive a second washer of the fastener assembly.

9. The adapter of claim 1, wherein the first open aperture is further defined by a third space of uniform diameter less than the diameter of the second space.

10. The adapter of claim 9, wherein the third space is configured to receive a head of a threaded fastener of the fastener assembly and wherein the drive surface is defined within the third space.

11. The adapter of claim 1, wherein the body comprises a continuous, monolithic body.

12. The adapter of claim 1, wherein the first and second apertures are separated by a portion of the body so as not to be in communication with one another.

13. The adapter of claim 1, wherein the first aperture is further defined by a second space of uniform diameter less than a diameter of the tapered sidewall, the second space of uniform diameter positioned distal to the front end relative to the tapered sidewall; and the drive surface formed in the body within the first aperture and configured to engage a corresponding drive surface of the one of the nut or bolt of the fastener assembly when the fastener assembly is received within the first aperture is positioned distal to the front end relative to the second space of uniform diameter.

14. A system for engaging a fastener assembly with a tool, comprising:

an adapter defining:

a first aperture formed in a first end thereof and defined by at least one tapered sidewall, the aperture having an open end configured to receive at least a portion of a fastener assembly;

a drive surface for engaging with a corresponding drive surface of the fastener assembly when the fastener assembly is received within the first aperture; and a second aperture defined in a second end, opposite the first end, and configured to engage with a tool for installing the fastener assembly; and a hardware insertion tool comprising a protrusion sized to be inserted into the first aperture of the adapter, the protrusion further comprising a recess formed therein and configured to accept a portion of the fastener assembly therein when the insertion tool is inserted into the first aperture.

15. The system of claim 14, wherein the tapered sidewall is sized to create an interference fit with a washer of the fastener assembly in response to a force urging the fastener assembly into the first aperture.

16. The system of claim 15, wherein the tapered sidewall defines a first opening of a first dimension at a first end thereof, and a second opening of a second dimension, less than the first dimension at a second end thereof, and wherein the first dimension is selected so as to be larger than an outer dimension of the washer of the fastener assembly configured to be inserted into the first aperture, and wherein the second dimension is selected so as to be smaller than the outer dimension of the washer.

17. The system of claim 14, wherein the drive surface comprises a surface of a protrusion formed on an end of the first aperture opposite the open end thereof.

18. An adapter for securing a fastener assembly including at least one washer and one of a nut or a bolt to a tool, comprising:

a body defining:

an aperture formed in a first end thereof and including a first space, a second space and a third space, the first space defining an open end comprising a cylindrical profile defined by a generally vertical sidewall extending to a depth D thereof and connected to an annular sidewall comprising defined by at least one a linearly tapered sidewall, the first space defining a first diameter D1 proximate the open end along the depth D and a smaller second diameter D2 oriented at a second end of the first space;

the second space comprising a generally cylindrical space defined by a vertical, annular sidewall of a diameter D3 extending from the second end of the first space, with diameter D3 being smaller than diameter D2, the second space configured to receive at least a portion of the fastener assembly, and sized in a region of the at least one linearly tapered sidewall to engage with one of the at least one washer of the fastener assembly when the fastener assembly is received therein;

the third space oriented at a second end of the second space and comprising a generally cylindrical space of a diameter D4, with diameter D4 being smaller than diameter D3, the third space being defined by a vertical, annular sidewall, the third space configured to accept a head of the nut or the bolt of the fastener assembly;

wherein the at least one washer inserted in said first space has a diameter between D1 and D2 and is positioned within the linearly tapered interior sidewall to engage in an interference fit with a portion of the linearly tapered interior sidewall, to thereby captivate the fastener assembly within the adapter, a drive surface formed in the body extending from an end of the third space in an axial direction of the adapter toward the open end, the drive surface configured to engage a corresponding drive surface of another component of the fastener assembly when the fastener assembly is received within the first aperture; and a recess defined in a second end of the body, opposite the first end, and configured to engage with a tool for installing the fastener assembly, wherein the aperture and the recess are separated by a portion of the body so as not to be in communication with one another.

* * * * *